US008613418B2

(12) United States Patent
Lee

(10) Patent No.: US 8,613,418 B2
(45) Date of Patent: Dec. 24, 2013

(54) ADJUSTABLE SLUMP MOLD FOR MOLDING A CLAY SLAB INTO A CERAMIC OBJECT

(75) Inventor: David Lee, Surrey (CA)

(73) Assignee: Melody Lee, Surrey (CA)

( * ) Notice: Subject to any disclaimer, the term of this patent is extended or adjusted under 35 U.S.C. 154(b) by 63 days.

(21) Appl. No.: 13/284,344

(22) Filed: Oct. 28, 2011

(65) Prior Publication Data

US 2012/0181416 A1 Jul. 19, 2012

Related U.S. Application Data

(60) Provisional application No. 61/432,540, filed on Jan. 13, 2011.

(51) Int. Cl.
*B28B 7/02* (2006.01)

(52) U.S. Cl.
USPC ..... 249/155; 249/159; 249/162; 249/164; 249/168

(58) Field of Classification Search
USPC ..... 249/155–157, 159, 162, 164, 168; 403/205, 265, 231, DIG. 9; 248/220.21–220.22
See application file for complete search history.

(56) References Cited

U.S. PATENT DOCUMENTS

| | | | | | |
|---|---|---|---|---|---|
| 34,489 | A * | 2/1862 | Hall, Jr. et al. | 40/700 |
| 1,099,010 | A * | 6/1914 | Book et al. | 249/146 |
| 1,170,430 | A * | 2/1916 | Dunn | 249/149 |
| 1,678,266 | A * | 7/1928 | Niestradt | 249/157 |
| 1,717,579 | A * | 6/1929 | Pape | 249/155 |
| 2,416,559 | A * | 2/1947 | Wilson | 249/16 |
| 2,652,866 | A * | 9/1953 | Drain | 144/144.51 |
| 3,082,496 | A * | 3/1963 | Bungeroth et al. | 164/435 |
| 4,131,242 | A * | 12/1978 | Flores | 242/437.3 |
| 5,332,191 | A * | 7/1994 | Nolan | 249/155 |
| 6,386,504 | B1 * | 5/2002 | Schemel | 249/102 |
| 7,014,161 | B2 * | 3/2006 | Rampf et al. | 249/120 |
| 7,121,520 | B2 * | 10/2006 | Khoo | 249/157 |

FOREIGN PATENT DOCUMENTS

| | | | | |
|---|---|---|---|---|
| JP | 01297213 A | * | 11/1989 | B28B 7/02 |
| JP | 04348907 A | * | 12/1992 | B28B 7/00 |

OTHER PUBLICATIONS

Slump Mold, Large Rectange—The Ceramic Shop, http://www.theceramicshop.com/store/product/140/Slump-Mold,-Large-Rectangle/, USA, Sep. 2008.

Square Bowl, http://maycocolors.com/index.php?page=shop.product_details&flypage=mayco_flypage.tpl&product_id=382&category_id =110&option=com_virtuemart&Itemid=93 Sep. 2008.

* cited by examiner

*Primary Examiner* — Dimple Bodawala
(74) *Attorney, Agent, or Firm* — Cameron IP

(57) ABSTRACT

The present invention relates to an adjustable slump mold for molding a clay slab into a ceramic object. The mold includes a plurality of elongate members. The mold also includes a plurality of connectors connected to and extending from first ends of the elongate members, respectively. Each connector is shaped to slidably receive an adjacent one of the elongate members. The elongate members are thereby slidably connected together via the connectors. The elongate members so connected together form an adjustable mold shape.

16 Claims, 11 Drawing Sheets

ADJUSTABLE SLUMP MOLD FOR MOLDING A CLAY SLAB INTO A CERAMIC OBJECT

CROSS REFERENCE TO RELATED APPLICATION

This application claims the benefit of provisional application No. 61/432,540 filed in the United States Patent and Trademark Office on Jan. 13, 2011, the disclosure of which is incorporated herein by reference and priority to which is claimed.

FIELD OF THE INVENTION

The present invention relates to a slump mold for the field of ceramics. In particular, the invention relates to an adjustable slump mold for molding a clay slab into a ceramic object.

DESCRIPTION OF THE RELATED ART

Some ceramic objects, such as plates or trays, are oftentimes formed by slump molds. Slump molds of the known prior art are made and sold in set sizes and forms.

This fixed variety of slump molds may act to limit the number and variety of sizes and shapes into which ceramic objects may be made. This may be particularly frustrating for ceramics professionals who deal with a high volume of clay slabs on a daily basis. This may also be frustrating for amateur ceramic enthusiasts who may not have an extensive set of molds nor the budget to invest in such equipment.

There is accordingly a need for an improved slump mold for the field of ceramics.

BRIEF SUMMARY OF INVENTION

The present invention provides a slump mold disclosed herein that overcomes the above disadvantages. It is an object of the present invention to provide an improved, adjustable slump mold.

There is accordingly provided an adjustable slump mold for molding a clay slab into a ceramic object. The mold includes a plurality of elongate members. The mold also includes a plurality of connectors connected to and extending from first ends of the elongate members, respectively. Each connector is shaped to slidably receive an adjacent one of the elongate members. The elongate members are thereby slidably connected together via the connectors. The elongate members so connected together form an adjustable mold shape.

There is also provided an adjustable slump mold for molding a clay slab into a ceramic object. The mold includes a plurality of elongate members having first ends and second ends spaced-apart from the first ends. The mold includes a plurality of connectors. Each connector is connected to and extends from a first end of one of the elongate members, respectively. Each connector is shaped to slidably receive an adjacent one of the elongate members at a location between the first end and the second end of the adjacent one of the elongate members. The elongate members are slidably connected together via the connectors thereby. The elongate members so connected together form an adjustable mold shape.

There is further provided an adjustable slump mold for molding a clay slab into a ceramic object. The mold includes a plurality of elongate members having first ends and second ends spaced-apart from the first ends. Each of the elongate members is a right-angled trapezium in cross-section. The mold includes a plurality of L-shaped brackets connected to and extending from first ends of the elongate members, respectively. The brackets have base portions extending horizontally from first ends of the elongate members, respectively. The brackets have upright portions extending perpendicular from the base portions. The upright portions are spaced-apart from the first ends of the elongate members. The brackets thus form passageways between the upright portions and the first ends of the elongate members. Each bracket, via its passageway and its base portion, is shaped to slidably receive an adjacent one of the elongate members at a location between the first end and the second end of the adjacent one of the elongate members. The elongate members are slidably connected together via the brackets thereby. The elongate members so connected together form an adjustable mold shape. The mold includes a plurality of fasteners configured to selectively, fixedly connect the elongate members together when a desired mold shape is determined. Each of the fasteners comprises a knob that is manually adjustable and a threaded member extending from the knob. The threaded members threadably connect to the upright portions of the brackets and are extendable therethrough to abut the elongate members via distal ends of the threaded members.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
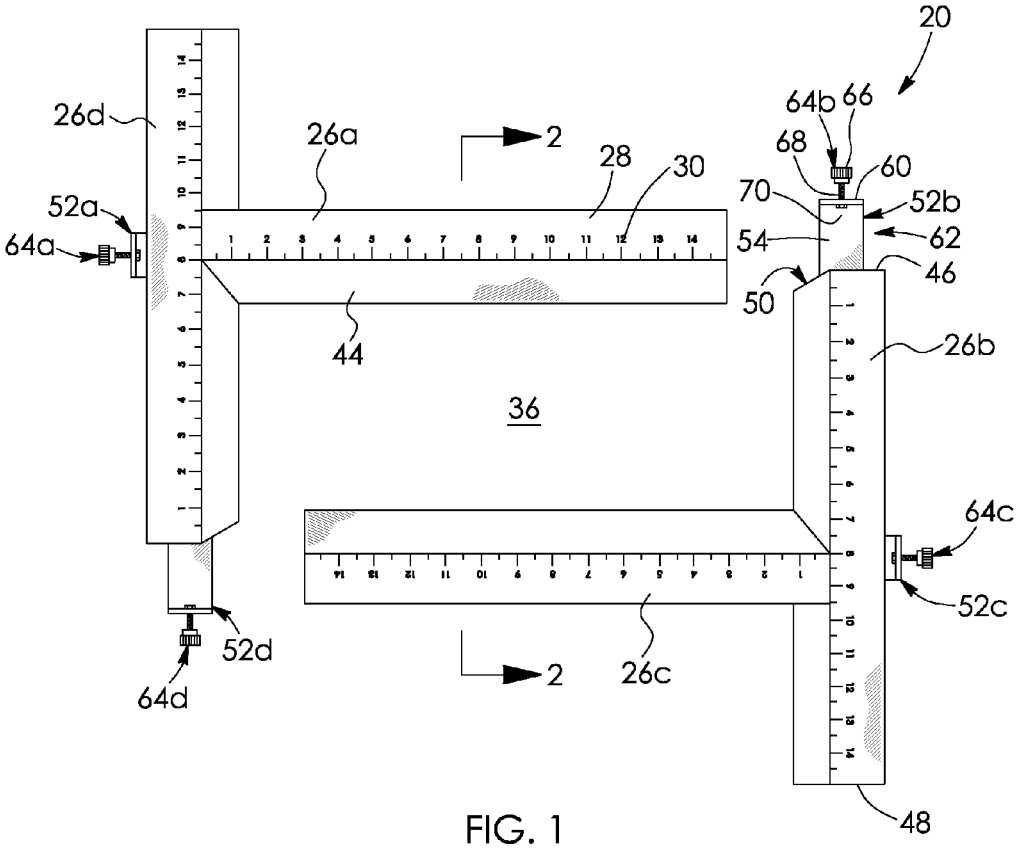
FIG. 1 is a top plan view of an adjustable slump mold according to one embodiment, the mold having four elongate members and a plurality of brackets for slidably connecting the elongate members together, the mold being shown in partially separated form.
Figure 4:
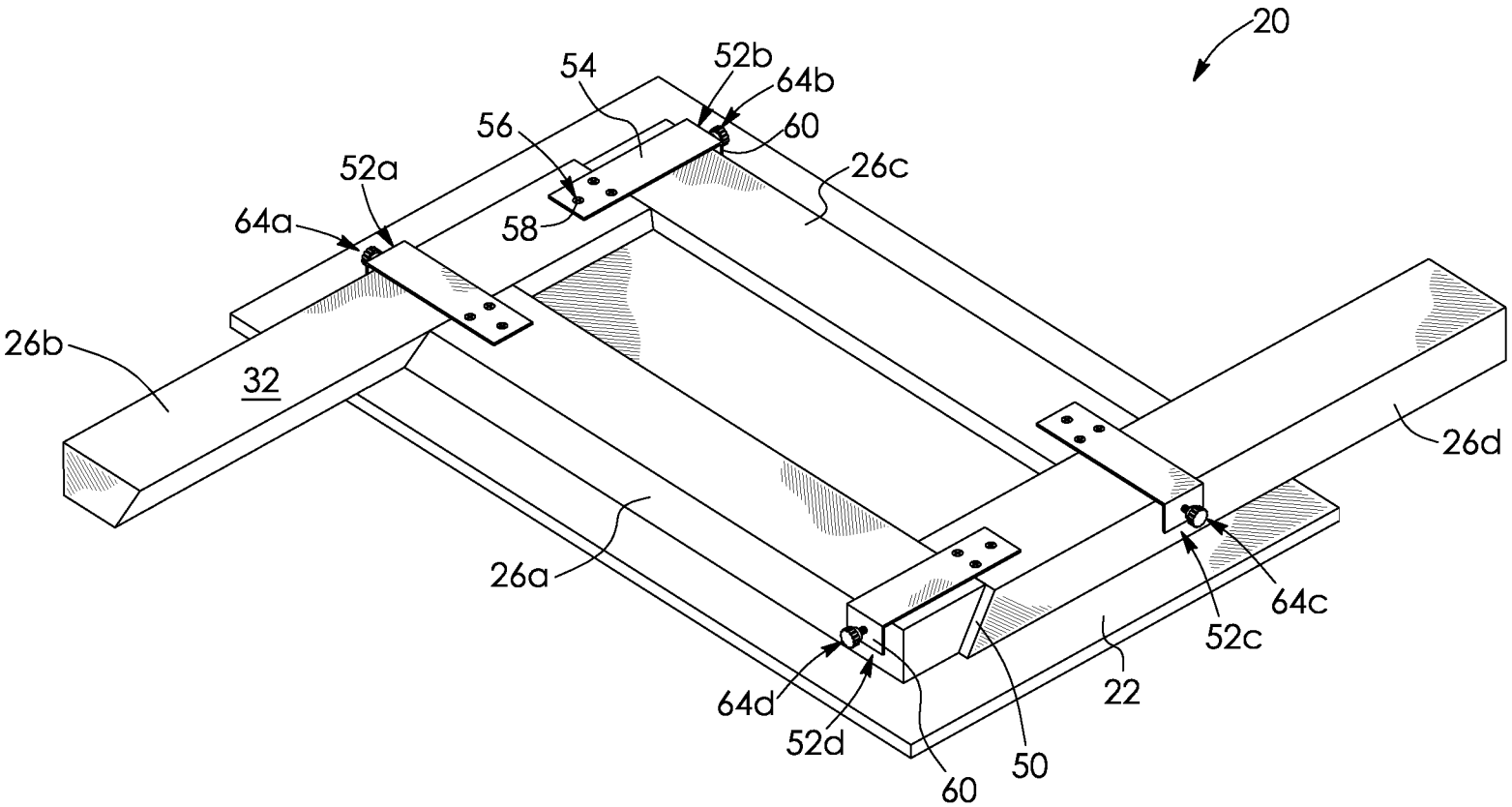
FIG. 4 is a perspective view of the mold shown in FIG. 3 together with a clay slab, the mold being arranged upside down, the mold overlaying the clay slab, and the elongate members being arranged to form a rectangular-shaped mold.
Figure 8:
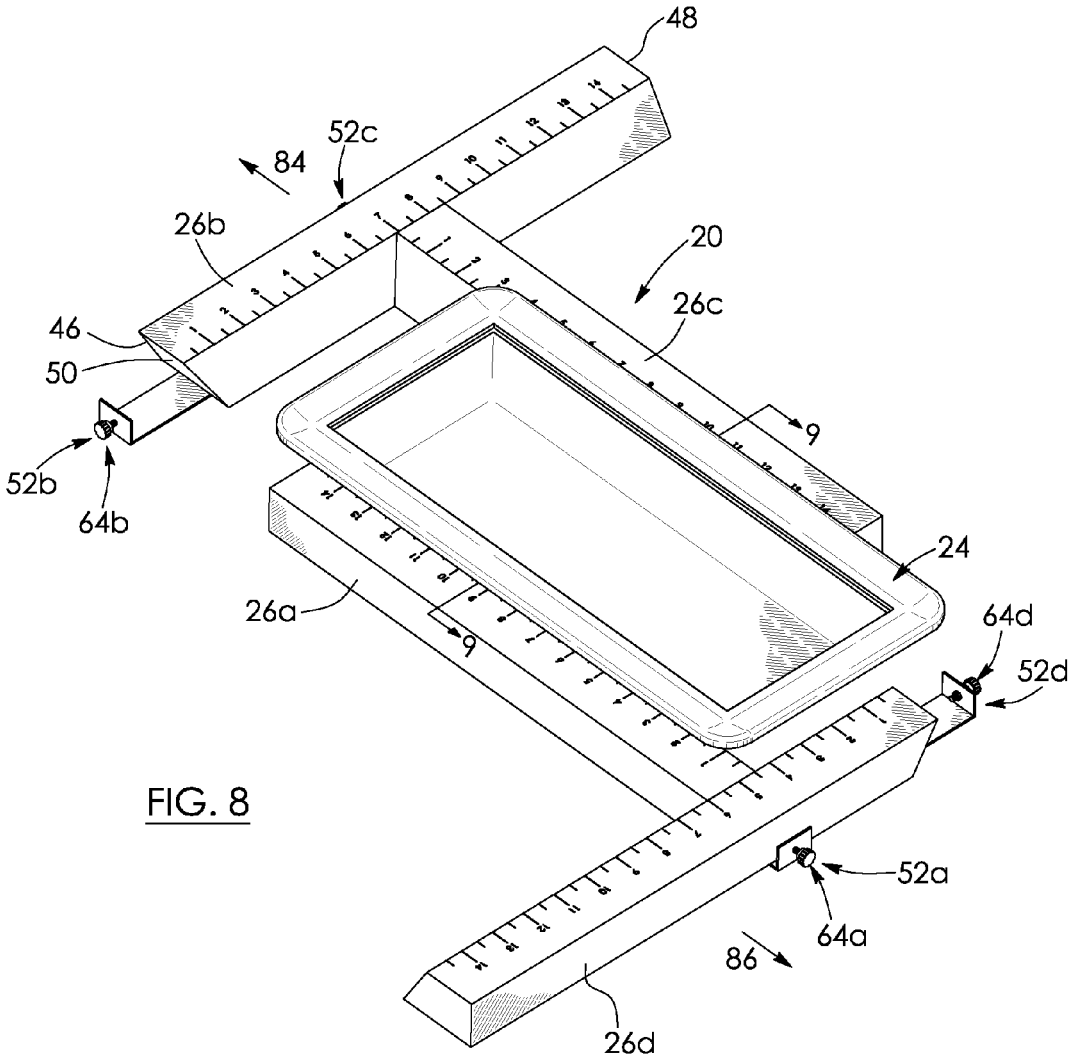
FIG. 8 is a perspective view of the mold and ceramic tray shown in FIG. 7, with some of the elongate members being shown disconnected from their respective brackets and being removed from the ceramic tray.

Referring to the drawings and first to FIG. 1, there is shown an adjustable slump mold 20 for molding a clay slab 22, shown in FIG. 4, into a ceramic object 24, shown in FIG. 8. As shown in FIG. 1, the mold has a plurality of elongate members, in this example four elongate members 26*a*, 26*b*, 26*c* and 26*d*. The elongate members are substantially identical to each other. According to one preferred embodiment, each of the elongate members is made of wood and is a right-angled trapezoid in cross-section, as shown in FIG. 2, though this is not strictly required.

Figure 2:
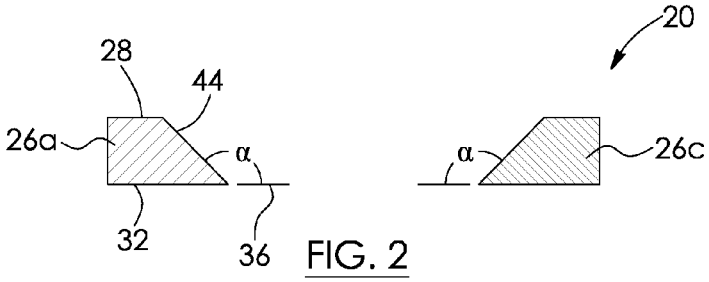
FIG. 2 is a cross-sectional view through lines 2-2 of FIG. 1 showing a cross-sectional profile of a pair of the elongate members of the mold of FIG. 1.
Figure 9:
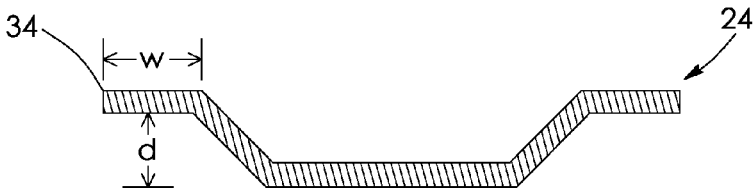
FIG. 9 is a cross-sectional view along the lines 9-9 of FIG. 8 showing a cross-sectional profile of the ceramic tray so formed.

Each elongate member, as shown by member 26*a* in FIG. 2, has a top surface 28. The top surfaces are shaped to correspond to a desired width w of a peripheral rim portion 34 of the ceramic object 24 as shown in FIG. 9. Each of the members, as shown by member 26*a*, has measurement indicia 30, shown in FIG. 1, disposed on the top surface. In this example, the measurement indicia delineates half inch intervals and the numbers 0 to 15 corresponding to 15 inches in length.

Referring back to FIG. 2, each of the elongate members, shown by member 26*a*, has a bottom surface 32 opposite its top surface 28. Both the top surfaces 28 and the bottom surfaces 32 of the elongate members are generally flat and are parallel with each other in this example. The bottom surfaces of the elongate members thus align in a plane 36.

Figure 3:
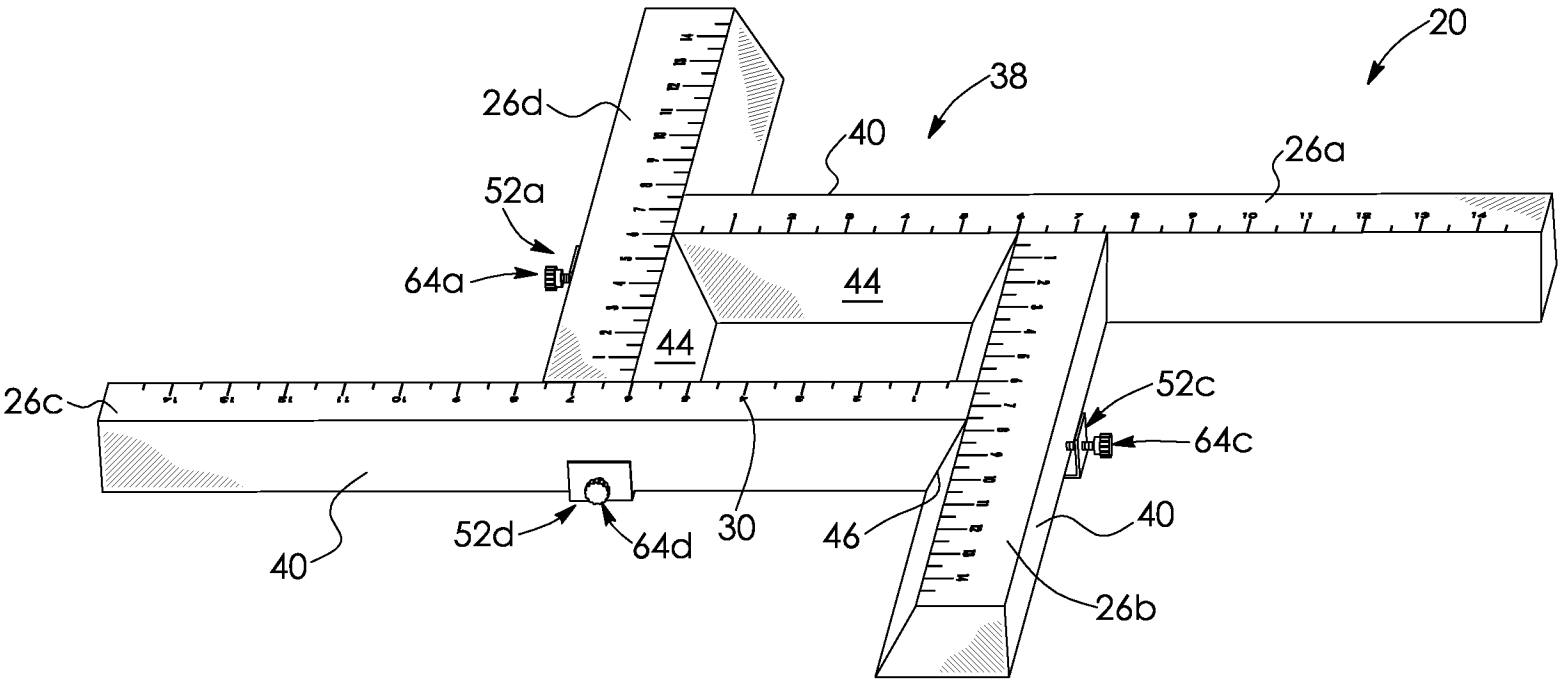
FIG. 3 is a perspective view of the mold shown in FIG. 1, the mold being shown with the elongate members fully connected together and arranged to form a square-shaped mold.
Figure 6:
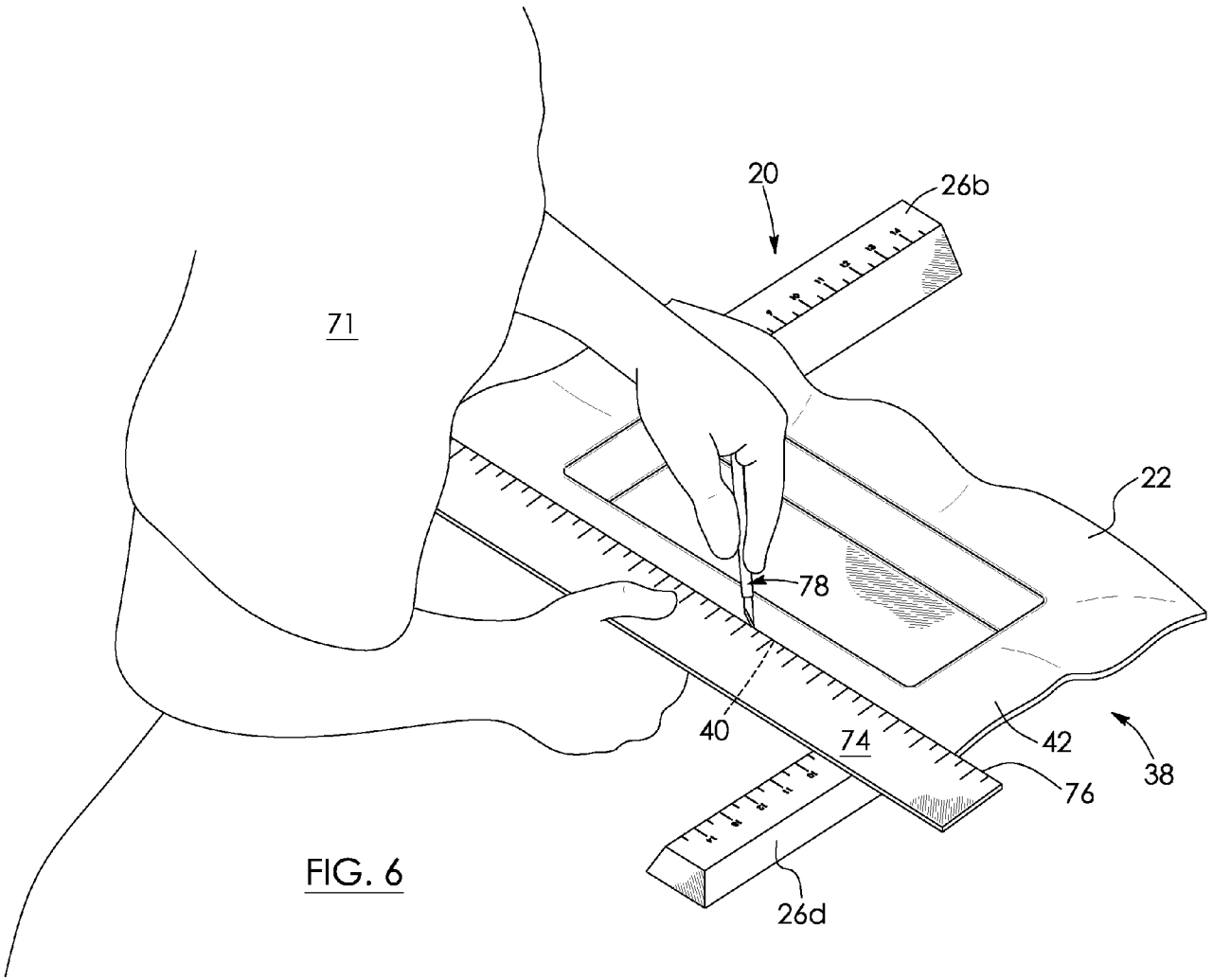
FIG. 6 is a perspective view of the mold shown in FIG. 5, the clay slab being fully pressed in place, and showing the user cutting away, with a cutting member, portions of the clay slab overlaying past the mold with a cutter and a ruler aligning with and overlaying the top of the mold.

As shown in FIG. 3, the mold 20 has an exterior 38. The elongate members, as shown by members 26*a* and 26*c*, each has a straight-edge 40. The straight-edges are disposed along the exterior 38 of the mold when the elongate members are connected together as shown in FIG. 3. The straight-edges 40 of the elongate members provide straight lines which facilitate cutting off of excess clay slab portions 42 extending past the exterior 38 of the mold as shown in FIG. 6.

Referring to FIG. 2, each elongate member also has an inclined elongate surface 44 interposed between and adjacent to its top surface 28 and bottom surface 32. The inclined elongate surfaces are angularly spaced-apart from the plane 36 by an exterior angle $\alpha$ that is equal to 120 degrees in this example, though this is not strictly required. In another embodiment, for example, $\alpha$ is equal to 140 degrees. The inclined elongate surfaces 44 are configured to partially face upwards and also partially face inwards with respect to other ones of the elongate members when the elongate members are connected together as, for example, shown in FIG. 3. The inclined elongate surfaces are dimensioned to generally correspond to a desired depth d of the ceramic object 24 as shown in FIG. 9.

Referring back to FIG. 1, each of the elongate members, as shown by elongate member 26*b*, has a first end 46 and a second end 48 spaced-apart from the first end. The elongate members, as shown by member 26*b* in FIG. 8, each has a distally disposed inclined end surface 50 at its first end. The inclined end surfaces are angled so as to match or minor the inclined elongate surfaces 44 of the elongate members shown in FIG. 1. The inclined nature of inclined end surfaces 50 is best shown in FIG. 4 for member 26*d*. Referring back to FIG. 1, the inclined end surfaces 50 are configured to both snugly abut the inclined elongate surfaces 44 and enable the bottom surfaces 32 of the elongate members so connected together to align in the plane 36.

The mold 20 includes a plurality of connectors, in this example, brackets 52*a*, 52*b*, 52*c* and 52*d* connected to and extending from the first ends 46 of the elongate members, respectively. This is shown, for example, by bracket 52*b* connecting to end 46 of member 26*b*. As seen in FIG. 1, each elongate member has a longitudinal axis, with brackets connecting to and extending from respective ends of said elongate members along the longitudinal axes.

The brackets are L-shaped and, as shown by bracket 52*b*, each has a base portion 54 extending horizontally outwards from the first end of the corresponding elongate member 26*b*. The base portion also extends in parallel with the bottom surface 32 of said corresponding member. As shown in FIG. 4, the base portions, as shown by base portion 54, connect to their respective elongate members, in this case member 26*b*, via in this example a plurality of screws 56 that extend through apertures 58 of the bracket and into member 26*b*.

Referring to FIGS. 1 and 4, each of the brackets also has an upright portion 60 extending perpendicularly upwards from its base portion 54. Both the base portions and upright portions of the brackets are generally rectangular in shape in this example. The upright portions of the brackets are spaced-apart from the first ends 46 of the elongate members. The brackets 52 thus form passageways 62 between the upright portions 60 and the first ends 46 of the elongate members. The brackets are shaped to receive the elongate members through said passageways 62. Adjacent ones of the elongate members are slidable through the passageways and along the base portions 54 of the brackets. Thus, each bracket is shaped to slidably receive an adjacent one of the elongate members and the elongate members 26 slidably connect together via the brackets 52.

Referring to FIG. 1, the mold 20 has a plurality of fasteners 64*a*, 64*b*, 64*c* and 64*d* each associated with a respective one of the brackets. The fasteners are configured to selectively fix positioning of the elongate members when a desired mold shape is determined. Each fastener, as shown by fastener 64*b*, includes a first part or gripping knob 66 that may be actuated to manually adjust the fastener and thus may be actuated. Each fastener, as shown by fastener 64*b*, also has a second part or threaded member 68 extending from said knob. The fasteners connect to the upright portions 60 of the brackets 52*b* via the threaded members. The threaded members 68 threadably connect to the brackets and are extendable through threaded apertures to abut the elongate members via distal ends 70 of the threaded members.

The fasteners 64 have first retracted positions, shown in FIG. 1, in which the elongate members are free to slide along and through the passageways 62 of the brackets. These first positions include where the distal ends 70 of the threaded members 68 are adjacent to the upright portions 60 of the brackets 52. Thus, for example, elongate member 26*a* may be received within bracket 52*b* between upright portion 60 and inclined end surface 50 of elongate member 26*b*.

The fasteners have second extended positions, shown in FIG. 3, in which, upon rotation of their knobs, the threaded members of the fasteners move inwards towards and partially within the passageways 62, shown in FIG. 1, such that the threaded members abut the elongate members. The fasteners in the second positions thus act to fix the elongate members in place and inhibit any further movement of the elongate members relative thereto. For example, as shown in FIG. 3, fastener 64*c* is configured to fix in place elongate member 26*b* relative to member 26*c*.

The mold as herein described, with its elongate members, brackets and fasteners, may thus form a mold shape that is adjustable. In this embodiment, the elongate members so connected together are adjustable to form both a rectangular mold-shape as shown in FIG. 4 and a square mold-shape as shown in FIG. 3. The measurement indicia 30 facilitates manipulation of the elongate members to the desired mold shape. This is shown in FIG. 3 where the distance between opposing inclined elongate surfaces 44 of the elongate members, as measured from the top surfaces thereof, is the same, in this example being equal to 6 inches. The measurement indicia 30 thus ensures that a desired square shape is achieved. A similar procedure may be employed via the measurement indicia to obtain a rectangular shape of the desired dimensions.

Figure 5:
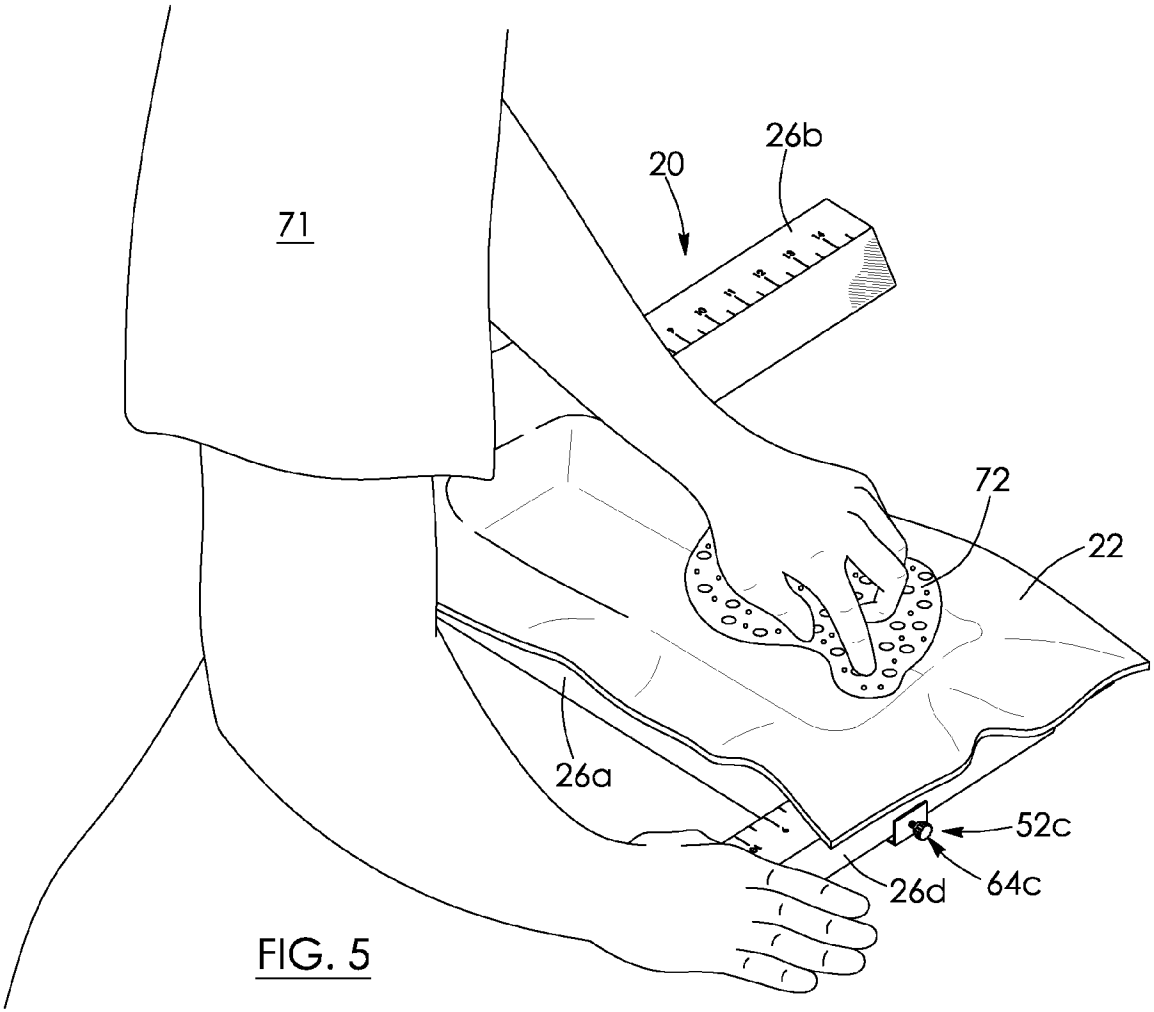
FIG. 5 is a perspective view of the mold shown in FIG. 4, the mold being right side up, and a user being shown using a sponge to manually press the clay slab into the mold.

Upon a desired mold shape being set, one may next overlay mold 20 onto the clay slab 22 as shown in FIG. 4. As shown in FIG. 5, the mold 20 and slab may then be overturned and the clay slab pressed into the mold by a potter 71 using a sponge 72. Referring next to FIG. 6, once the clay slab has been fully pressed into the mold, an object, in this example a ruler 74, having a straight edge 76 may be placed on an underlying elongate member and/or adjacent elongate members and be used in conjunction with a cutting member, in this example a fettling knife 78, to cut off excess portions 42 of the clay slab 22 extending past the exterior 38 of the mold. The straight-edges 40 of the elongate members as shown in FIG. 3 may also be used in conjunction with ruler 74 to facilitate cutting off of excess clay slab portions 42.

Figure 7:
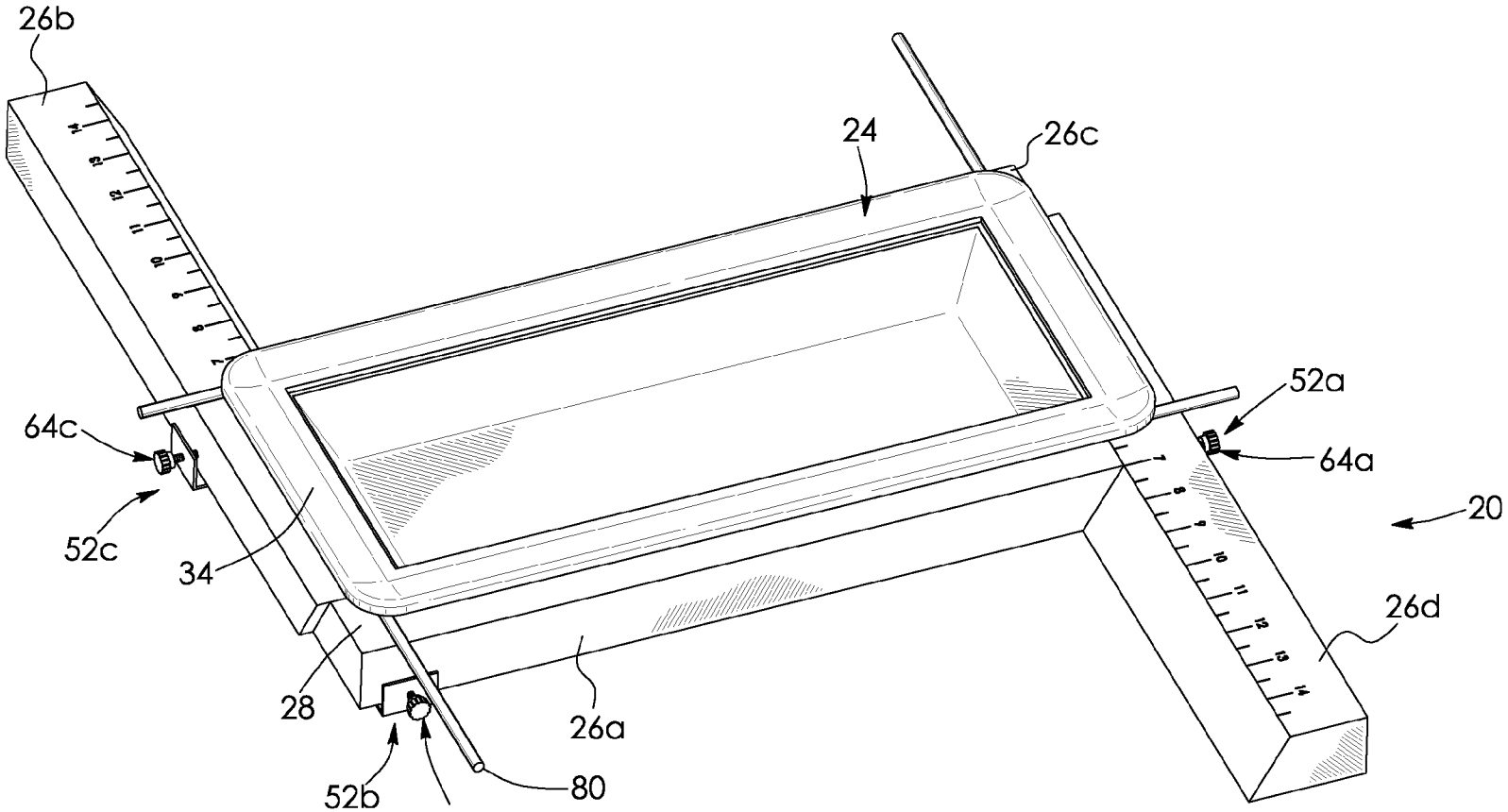
FIG. 7 is a perspective view of the mold and clay slab received therein shown in FIG. 6, the clay slab being in the form of a ceramic object, in this example, a rectangular ceramic tray.

FIG. 7 shows the clay slab in the form of the desired ceramic object 24. Rods 80 may be disposed between the rim portions 34 of the ceramic object and the top surfaces 28 of the elongate members 26 if desired in order to provide the rim portions of the ceramic object with an upward extending, tapered profile. When the ceramic object is sufficiently hardened, the mold 20 may be removed from the ceramic object as shown in FIG. 8. This is done by selectively loosening some or all of the fasteners, in this example fasteners 52*b* and 52*d*, and then pulling the elongate members outwards from the ceramic object, as indicated by directional arrows 84 and 86. The ceramic object so formed may now be placed in a kiln.

Figure 10:
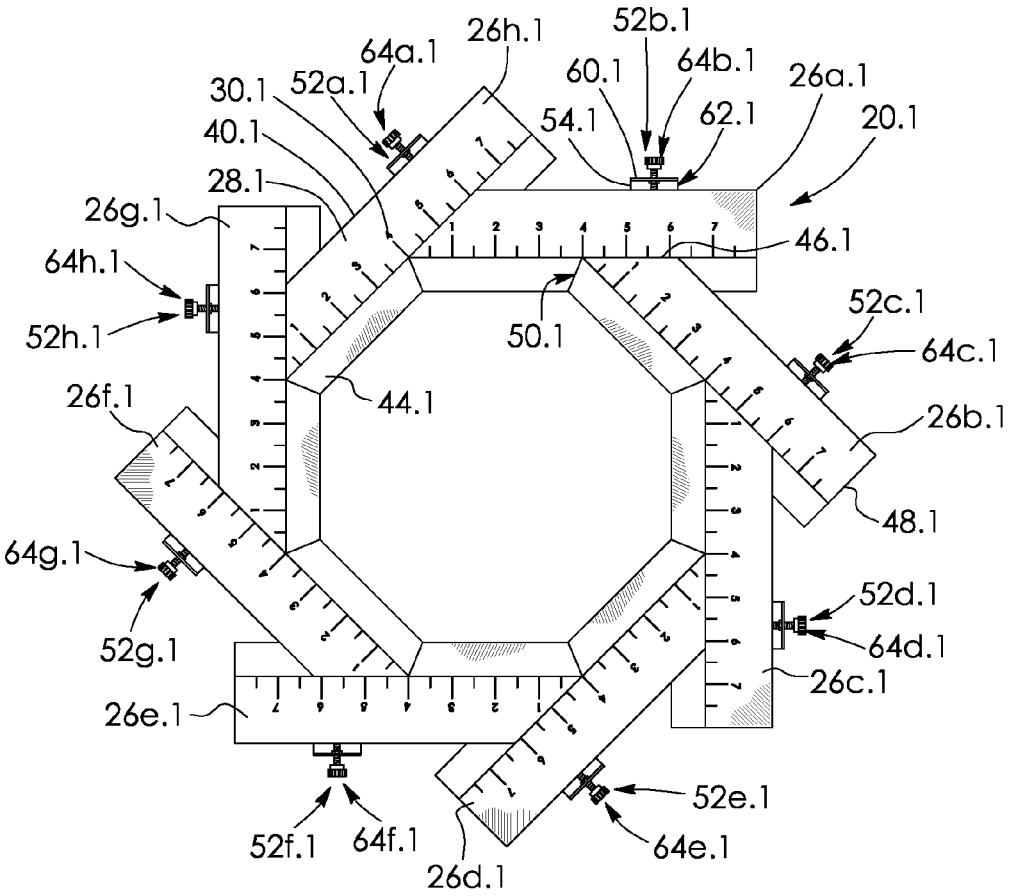
FIG. 10 is a top plan view of an adjustable slump mold according to another embodiment, the mold having eight elongate members connected together to form an octagonal-shaped mold.
Figure 11:
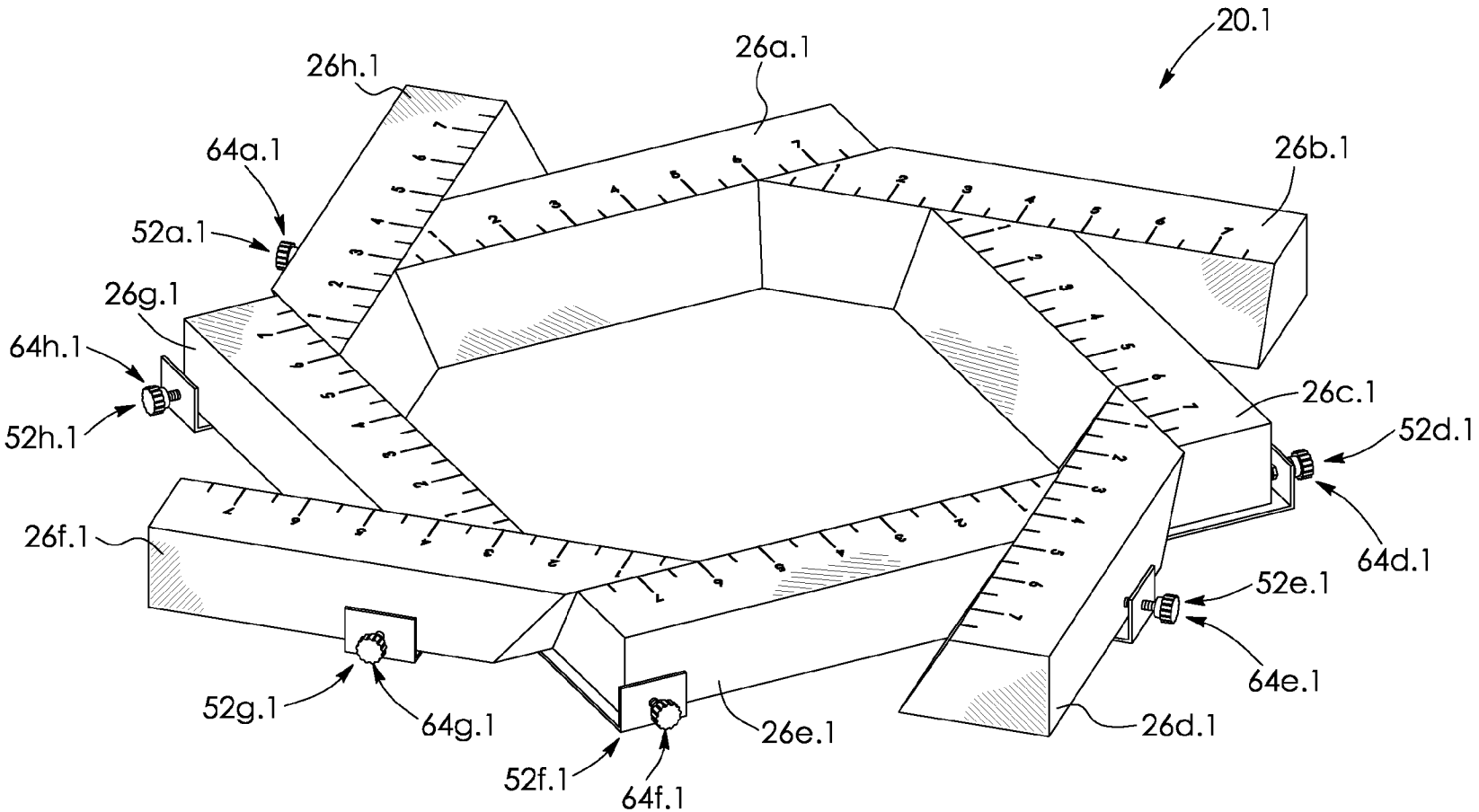
FIG. 11 is a top perspective view of the mold shown in FIG. 10.
Figure 12:
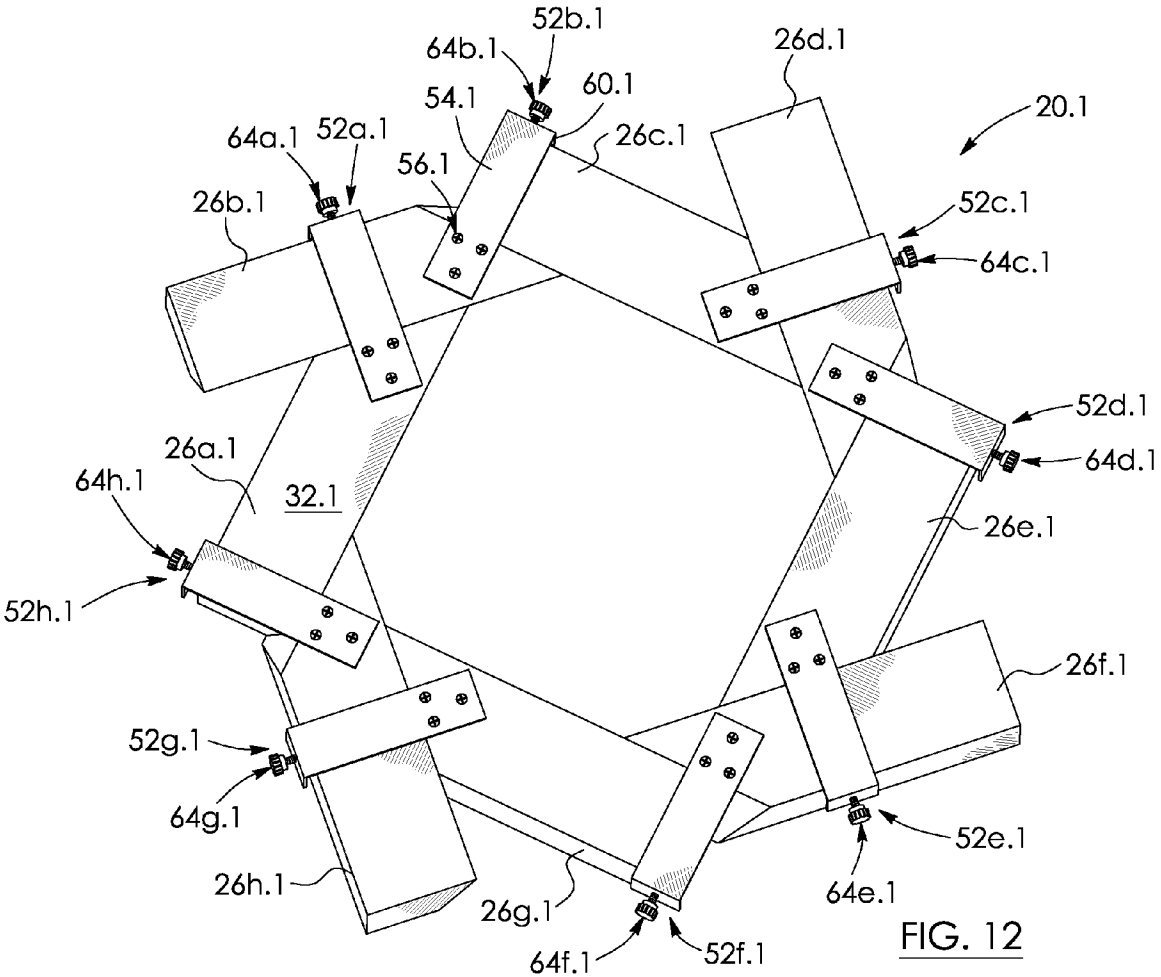
FIG. 12 is a bottom plan view of the mold shown in FIG. 10.

FIGS. 10 to 12 show an adjustable slump mold 20.1 according to another embodiment. Like parts have like numbers and functions as those shown in FIGS. 1 to 9 with the addition of decimal extension "0.1". Mold 20.1 is substantially the same as mold 20 shown in FIGS. 1 to 9 with the exception that it consists of eight elongate members 26*a*.1, 26*b*.1, 26*c*.1, 26*d*.1, 26*e*.1, 26*f*.1, 26*g*.1, and 26*h*.1. The elongate members so connected together may form a variety of octagonal mold-shapes. The specific size of the octagonal mold-shapes may vary by adjusting the relative positions of the elongate members in a substantially similar manner as described above for mold 20.

Figure 13:
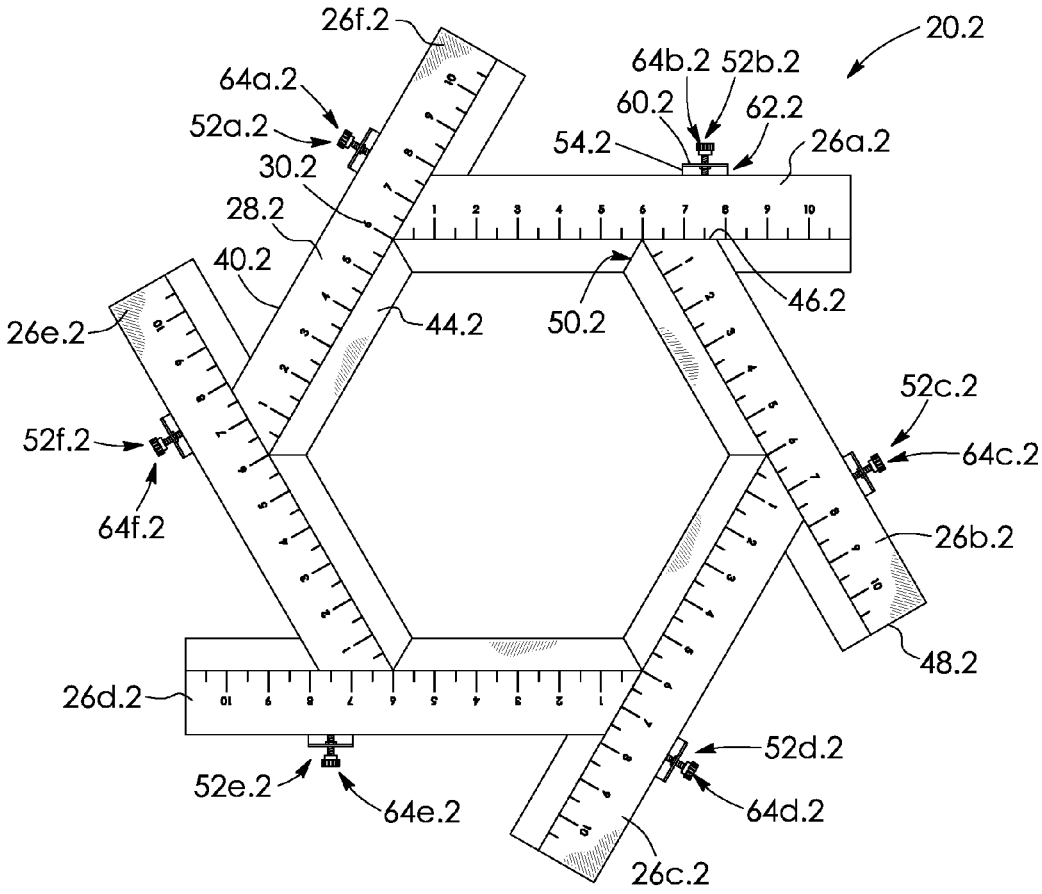
FIG. 13 is a top plan view of an adjustable slump mold according a further embodiment, the mold having six elongate members connected together to form a hexagonal-shaped mold.

FIG. 13 shows an adjustable slump mold 20.2 according to a further embodiment. Like parts have like numbers and functions as those shown in FIGS. 1 to 9 with the addition of decimal extension "0.2". Mold 20.2 is substantially the same as mold 20 shown in FIGS. 1 to 9 with the exception that it consists of six elongate members 26*a*.2, 26*b*.2, 26*c*.2, 26*d*.2, 26*e*.2 and 26*f*.2. The elongate members so connected together may form a variety of hexagonal mold-shapes. The specific size of the hexagonal mold-shapes may vary by adjusting the relative positions of the elongate members in a substantially similar manner as described above for mold 20.

It will be appreciated that many variations are possible within the scope of the invention described herein. Also, it will be understood by someone skilled in the art that many of the details provided above are by way of example only and are not intended to limit the scope of the invention which is to be determined with reference to the following claims.

What is claimed is:

1. An adjustable slump mold for molding a clay slab into a ceramic object, the mold comprising:

a plurality of elongate members each having a longitudinal axis and a bottom surface;

a plurality of L-shaped brackets connecting to and extending outwards from respective ones of the ends of the elongate members along the longitudinal axes of the elongate members, each said bracket having a base portion extending horizontally from the bottom surface of a first end of its elongate member in parallel with the longitudinal axis of its elongate member and each said bracket having an upright portion extending perpendicular from its base portion, the upright portions being spaced-apart from the first ends of the elongate members, each said bracket thus forming a passageway between its upright portion and the first end of its elongate member, each said bracket being thus shaped to slidably receive an adjacent one of the elongate members through its passageway with its base portion abutting the bottom surface of said adjacent one of the elongate members, wherein each said elongate member has a second end spaced-apart from its first end, the longitudinal axis of each said elongate member extending from its first end to its second end, and wherein each said bracket is shaped to slidably receive said adjacent one of the elongate members at a location between the first end and the second end of said adjacent one of the elongate members, the elongate members so connected together forming an adjustable mold shape.

2. The mold as claimed in claim 1 further including a plurality of fasteners configured to selectively, fixedly connect the elongate members together when a desired mold shape is determined.

3. The mold as claimed in claim 2 wherein the fasteners are threaded and threadably connect to and are extendable through respective ones of the brackets via threaded apertures of the brackets.

4. The mold as claimed in claim 1 further including a plurality of fasteners configured to selectively, fixedly connect the elongate members together when a desired mold shape is determined, the fasteners having first parts that may be actuated and second parts extending from the first parts, the fasteners connecting to the upright portions of the brackets via the second parts of the fasteners, the fasteners having first, retracted positions in which the elongate members are free to slide along and through the passageways of the brackets and the fasteners having second, extended positions in which, upon actuation of the first parts of the fasteners, the second parts of the fasteners move inwards towards and partially within the passageways such that the second parts of the fasteners abut the elongate members, thus acting to fix the elongate members in place and inhibiting any further movement of the elongate members relative thereto.

5. The mold as claimed in claim 2 wherein the fasteners each comprise a knob that is manually adjustable and a threaded member extending from said knob, the threaded members threadably connecting to the brackets and being extendable therethrough to abut the elongate members via distal ends of said threaded members.

6. The mold as claimed in claim 1 wherein each of the elongate members has an inclined elongate surface, the inclined elongate surfaces being configured to face upwards and also face respective other ones of the elongate members when the elongate members are connected together via the brackets, the inclined elongate surfaces corresponding to a desired depth of the ceramic object.

7. The mold as claimed in claim 6, wherein the elongate members have top surfaces adjacent to the inclined elongate surfaces, and wherein the elongate members have measurement indicia disposed on said top surfaces, the measurement indicia facilitating manipulation of the elongate members to the desired mold shape.

8. The mold as claimed in claim 7, wherein the top surfaces of the elongate members are shaped to correspond to a desired size of a peripheral rim portion of the ceramic object.

9. The mold as claimed in claim 6 wherein the elongate members have inclined end surfaces at the first ends of the elongate members, said inclined end surfaces being angled so as to match the inclined elongate surfaces of the elongate members, the elongate members being snugly and slidably received between the brackets and said inclined end surfaces.

10. The mold as claimed in claim 6 wherein the bottom surfaces are adjacent to the inclined elongate surfaces and wherein the elongate members have distally disposed inclined end surfaces at the first ends of the elongate members, said inclined end surfaces being configured to snugly abut the inclined elongate surfaces and enable the bottom surfaces of the elongate members so connected together to align in a plane.

11. The mold as claimed in claim 1, wherein the mold has an exterior and wherein the elongate members each has a straight-edge, said straight-edges being disposed along the exterior of the mold when the elongate members are connected together via the brackets, said straight-edges of the elongate members providing straight lines which facilitate cutting off of excess clay slab portions extending past the exterior of the mold.

12. The mold as claimed in claim 1 wherein each of the elongate members is a right-angled trapezoid in cross-section.

13. The mold as claimed in claim 1 wherein the plurality of elongate members consists of four elongate members, the elongate members so connected together being adjustable to form rectangular and square mold-shapes.

14. The mold as claimed in claim 1 wherein the plurality of elongate members consists of six elongate members and the elongate members so connected together form a plurality of hexagonal mold-shapes.

15. The mold as claimed in claim 1 wherein the plurality of elongate members consists of eight elongate members and the elongate members so connected together form a plurality of octagonal mold-shapes.

16. The mold as claimed in claim 1, wherein each of the elongate members has a top surface with measurement indicia disposed on said top surface, the top surfaces being spaced-apart from from the bottom surfaces of the elongate members.

* * * * *

UNITED STATES PATENT AND TRADEMARK OFFICE

CERTIFICATE OF CORRECTION

PATENT NO. : 8,613,418 B2
APPLICATION NO. : 13/284344
DATED : December 24, 2013
INVENTOR(S) : David Lee It is certified that error appears in the above-identified patent and that said Letters Patent is hereby corrected as shown below:

In the Claims:

Column 8, line 1, should read as follows:

11. The mold as claimed in claim 1, wherein the mold has an exterior and wherein each of the elongate members has a straight-edge, said straight-edges being disposed along the exterior of the mold when the elongate members are connected together via the brackets, said straight-edges of the elongate members providing straight lines which facilitate cutting off of excess clay slab portions extending past the exterior of the mold.

Signed and Sealed this
Twenty-fifth Day of March, 2014

Michelle K. Lee

Michelle K. Lee
*Deputy Director of the United States Patent and Trademark Office*